United States Patent [19]

Wildman et al.

[11] 4,213,612

[45] Jul. 22, 1980

[54] SHIFTABLE GAME TARGET AND PROJECTILE LAUNCHING DEVICE FOR ACTUATING SAME

[75] Inventors: John R. Wildman, North Riverside; Burton C. Meyer, Downers Grove, both of Ill.

[73] Assignee: Marvin Glass & Associates, Chicago, Ill.

[21] Appl. No.: 892,169

[22] Filed: Mar. 31, 1978

[51] Int. Cl.[3] ..... A63F 9/14; A63B 63/00; A63B 65/12

[52] U.S. Cl. ..... 273/355; 273/86 R; 273/86 F; 273/357; 273/383; 273/397

[58] Field of Search ..... 273/101, 86 R, 86 D, 273/86 E, 86 F, 86 G, 86 H, 105.6, 103, 102.1 C, 105.2

[56] References Cited

U.S. PATENT DOCUMENTS

| | | | |
|---|---|---|---|
| 719,141 | 1/1903 | Reinhardt | 273/101 |
| 1,650,935 | 11/1927 | Cox | 273/101 |
| 2,678,215 | 5/1954 | Peterson et al. | 273/86 D X |
| 3,572,712 | 3/1971 | Vick | 273/86 F |
| 3,820,788 | 6/1974 | Goldfarb et al. | 273/86 D |

FOREIGN PATENT DOCUMENTS

| | | | |
|---|---|---|---|
| 18934 | of 1908 | United Kingdom | 273/102.1 C |

*Primary Examiner*—George J. Marlo
*Attorney, Agent, or Firm*—Mason, Kolehmainen, Rathburn & Wyss

[57] ABSTRACT

A competitive action game includes a playing field which is inclined downwardly from its center to first and second player stations at opposite ends. Shooting assemblies are positioned at the player stations to shoot projectiles at one of two targets mounted for transverse movement across the center of the playing field. Each target includes a rotary disc member, a release mechanism and a biasing device to bias the target toward one side of the field. Each target release mechanism also includes a latch engageable with a rotary member and having a portion extending adjacent the playing field for contact by the projectiles that will actuate the latch allowing the target to move toward the scoring end of the field under the face of the biasing means. A score indicating flag is mounted at the end of the track to indicate the completion of the game.

16 Claims, 6 Drawing Figures

3
T
36'
17'
16'
20'
26'
96'
98'
126'
62'
60'
54'
116'
22'
71'
72'
24'
74
82
70
78
60
54
66
24
26
80
74
124
126
130
128
132
116
98
62
96
22
71
68
72
20
34
32
36
16
10
52a
17
12
40
46
44
48
38
14
53
53a
42
3

52a
52
40
46
48
44
50
51
38
14
42
53a 130
128
126
132
70
124
116
122
68
120
118

SHIFTABLE GAME TARGET AND PROJECTILE LAUNCHING DEVICE FOR ACTUATING SAME

BACKGROUND OF THE INVENTION

A. Field of the Invention

The device of the present invention relates to a new and improved competitive action game.

B. Description of the Prior Art

Recently, games considered most enjoyable by the public are competitive games that pit a player against a target or two players against two different targets wherein the players seek to hit the target with projectiles. The player striking the target most often in a given period of time wins the game.

One type of competitive game that is popular requires hitting a target by a projectile to move the target a predetermined distance. These prior art competitive games are highly desirable for family entertainment, and members of the family may join in taking on the winner of the previous game to provide much enjoyment for all members of the family.

SUMMARY OF THE INVENTION

An object of the present invention is to provide a new and improved competitive action game.

Another object of the present invention is to provide a new and improved competitive action game including targets movable a predetermined distance on a track upon engagement by a projectile shot by a player.

Another object of the present invention is to provide a new and improved competitive action game including a playing field with player stations on opposite sides of the playing field. A launching device for shooting projectiles is mounted at each player station and a pair of targets are mounted for movement upon engagement of a projectile launched from the player station.

Briefly, the present invention is directed to a new and improved competitive action game including a playing field having player stations defined on opposite ends. Each player station includes a launching device for shooting projectiles at a target. Two targets are provided, one for each player and each target includes a pinion gear mounted on a rack which is biased towards one end of the track. A latching mechanism is provided on the target mechanism and includes a depending portion that, upon engagement with a projectile, releases the target and allows the target to move a predetermined distance along the length of the rack. The winner of the competitive action game is determined by the first player to move the target the full length of the track by scoring by a projectile engaging the latch of the target.

DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF THE PREFERRED EMBODIMENT

Figures 1, 3, 5:
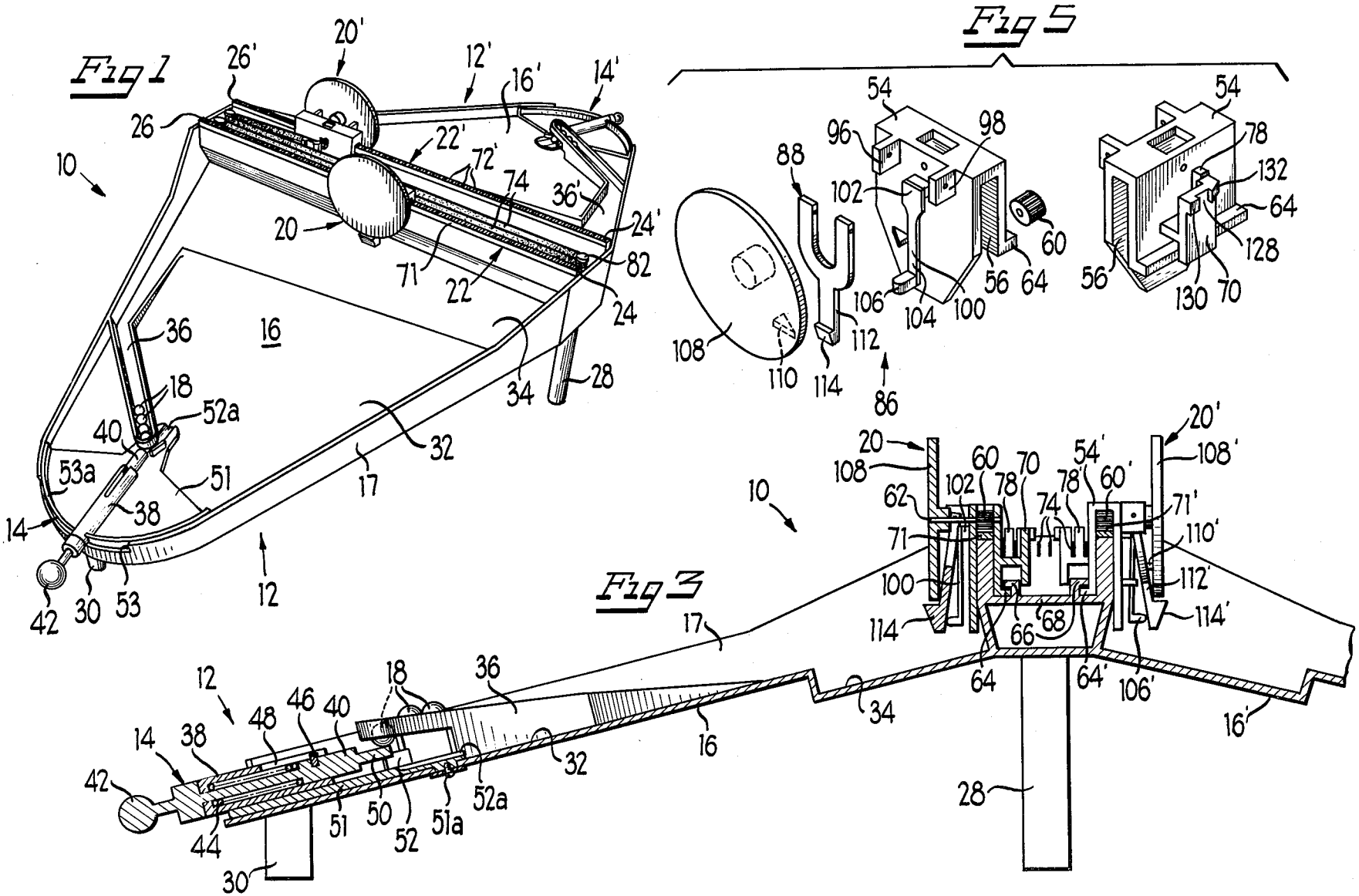
FIG. 1 is a perspective view of a competitive action game constructed in accordance with the principles of the present invention.
FIG. 3 is a vertical cross-sectional view taken along lines 3—3 in FIG. 2.
FIG. 5 is an exploded, perspective view of one of the targets of the present game.

Having reference now to the drawings and initially to FIG. 1, there is illustrated a competitive action game generally designated by the reference numeral 10. The competitive action game 10 is a shooting type game and includes, in the preferred embodiment, first 12 and second 12' player positions or stations including a shooting device generally designated by the reference numerals 14 and 14'. For convenience of description and since the competitive action game 10 illustrated is of a two player type where identical parts or components are employed, a prime on the reference numeral of the second player station and side of the game 10 will be employed. In addition, if the corresponding component is identical to the first component, it will not be described in addition to the first component.

The competitive action game 10 includes a playing surface 16 with a peripheral wall 17 along which a projectile such as a ball or marble 18 is propelled by the shooter 14. The balls 18 are propelled or shot along the surface 16 at a target generally designated by the reference numeral 20. The target 20 is movably mounted on a track 22 that in the preferred embodiment is aligned transversely to the playing surface 16. The general theme of the competitive action game 10 is to propel or shoot a projectile 18 by the shooter 14 at the target 20. Upon engagement of the projectile 18 with a certain portion of the target 20, the target 20 moves a predetermined distance along the track 22 from a first end 24 to a second, scoring end 26.

For the convenience of the players, once a projectile 18 has been shot, it is returned to the player station 12 under the influence of gravity. This is accomplished by inclining the playing surface 16 downwardly from the target 20 to the player station 12. This inclination is provided by the employment of legs 28 and 30. Leg 28 elevates the track 22 higher than the player station 12 that is elevated by the shorter leg 30.

In addition, the playing surface 16 is bilevel (FIG. 3) including a plateau or upper surface 32 and a lower surface 34 adjacent the target 20. This stepped configuration of the playing surface 16 is important since the projectiles 18 are propelled or shot along the surface 32 and are projected into the air after leaving the surface 32 causing it to be propelled at the target 20. Once leaving the plateau or upper surface 32, the projectile 18 tends to descend or arc downwardly. The target 20 includes a lower portion of a predetermined size to extend within the line of travel of a propelled projectile 18. A further description of this action will be described hereinafter.

The playing surface 16 includes a ramp 36 that extends from the lower surface 34 of the playing field 16 to the end of the shooter 14 thus providing a constant supply of projectiles for the player operating the shooter 14.

The shooter 14 includes a cylinder 38 and a plunger 40 mounted for axial movement within the cylinder.

Figures 2, 4, 6:
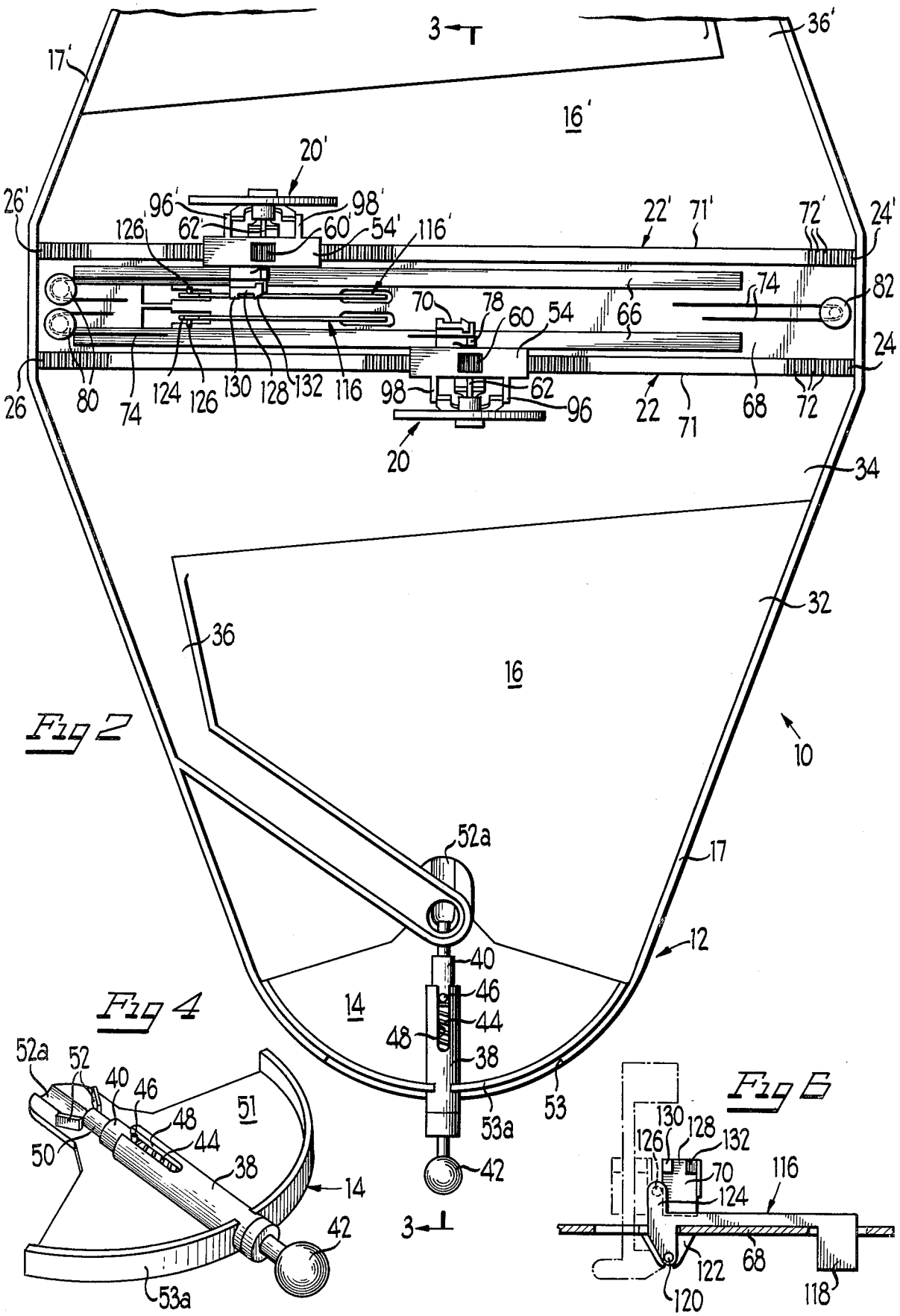
FIG. 2 is an enlarged, partially-fragmented and sectional view of the competitive game illustrated in FIG. 1.
FIG. 4 is a partial view of the shooting device of the competitive game.
FIG. 6 is a partial, enlarged view of the scoring device of the competitive game.

The plunger 40 includes a knob or handle portion 42 which may be gripped by the player and moved against the force of a compression spring 44 mounted within the cylinder 38. A player may shoot a ball 18 by grasping the knob or handle 42 and pulling the rod 40 inwardly into the cylinder 38 against the bias of the spring 44. Upon complete withdrawal of the rod 40 within the cylinder 38 as defined by a stop tab 46 which extends through a slot 48 in the top of the cylinder 38, the nose or projectile engaging end 50 of the rod 40 is pulled away from the ramp 36 allowing a projectile 18 to drop onto the depressed ramp portion 52*a* in front of the nose 50. The projectile 18 is held in this position in front of the rod 40 by a pair of guide rails 52 (FIG. 4). Upon release of the handle or knob 42, the rod 40 is pushed forward under the influence of the spring 44 to engage the projectile 18 propelling it along a depressed ramp portion 52*a* in the playing surface 16, toward the target 22.

The shooter 14 is mounted for pivotal movement by a support platform 51 secured to the playing field 16 by a pivot pin or screw 51*a*. This structure permits the player to rotate the shooter 14 relative to the target 20 for proper aiming. The peripheral wall 17 includes a cut out 53 allowing the shooter 14 to extend through the wall 17 permitting the player to pivot the platform 51. A lower peripheral wall 53*a* on the platform 51 may be integrally molded with the cylinder 38 to prevent the escape of ball 18 through the cut out 53.

If the projectile 18 engages the target 20 at preselected position, the target 20 moves along the track 22 a predetermined distance less than the full length of the track 22 such that the target 20 must be successingly engaged by a projectile 18 in order to move the full length of the track 22. The object of winning the competitive action game 10 is to repeatedly impinge the target 20 by projectiles 18 enough times to move the target 20 the full length of the track 22. The first player to move his respective target 20 the full length of the track 22 wins the game.

With reference now to the target 20, and with particular reference to FIG. 5 the target 20 includes a unitary housing 54 including a downwardly directed U-shaped slot 56 which straddles the track 22. A pinion gear 60 is rotatably mounted on the housing 54 and within the slot 56 by a rod 62 extending through the housing 54. To maintain the housing 54 securely on the track 22, the housing 54 includes a rearwardly directed flange 64 positioning within an L-shaped rail 66 defined on the track support sub-frame 68 secured to the top of playing surface 16 (FIG. 3). An outer rear flange 70 is also secured to the housing 54 and overlaps the rail 66 as seen in FIG. 3.

A gear rack 71 is mounted on the top of the track 22 with its teeth 72 in meshing engagement with the teeth of the pinion gear 60. Accordingly, upon rotation of the gear 60, the target will be moved along the length of the track 22.

A biasing means generally designated by the reference numeral 74 (FIG. 2) is provided to bias the housing 54 in a direction from the end 24 of the track 22 to the end 26. The biasing means is in the form of a flexible band secured to a post 78 defined on the rear of the target housing 54 at one end. The band 74 is wrapped around a pulley 80 and around a second post 82 defined on the playing surface. The opposite end of the band 74 is connected to the other target in a similar manner. The biasing means 74 applies a biasing force in the same direction on both target housings 54 and 54' tending to bias both targets 20 and 20' from the first end 24 of the tracks 22 and 22' toward the scoring ends 26 and 26'.

As previously mentioned the targets move only a predetermined distance along the racks 71 and 71' upon each engagement with a projectile 18. This predetermined distance is defined by one revolution of the gear 60. The target 20 includes a latching mechanism generally designated by the reference numeral 86 to permit rotation of the gear 60 and thus allow movement of the target 20 along the track 22.

Referring particularly to FIG. 5, the latching mechanism 86 includes a Y-shaped latch 88 pivotally secured at its top to tabs 96 and 98 fabricated on the housing 54 allowing the latch 88 to pivot relative to the housing 54. The latch 88 is biased outwardly away from the housing 54 by a resilient lever 100 secured at one end 102 to the housing 54. The lever 100 includes a free end 104 and an abutment member 106 for engaging the back of the latch 88 and tending to bias the latch 88 away from the housing 54. The latching mechanism 86 also includes a target disc 108 which is rotatably mounted by the pin 62. Accordingly, rotation of the gear 60 on the track 22 requires rotation of the target disc 108.

The disc 108 includes a detent or flange 110 extending rearwardly from the back surface of the disc 108 which engages the lower portion 112 of the latch 88 (see FIG. 3). In this position, the disc 108 is prevented from rotating thus preventing the rotation of the gear 60 and movement of the target 20.

The latch 88 includes a depending striking portion 114 which extends below the disc 108 (FIG. 3) in a position such that it may be engaged by a projectile 18. If engagement by a projectile occurs the latch 88 is pivoted against the biasing lever 100 moving the portion 112 out of engagement with the detent 110. Once the detent 110 is moved, the disc 108 is free to rotate one full revolution under the influence of the biasing member 74, through its connection to the gear 60. The housing 54 will therefore move along the track 22 the linear distance equal to one full revolution of the disc 108. Upon one full revolution of the disc 108, the detent 110 again engages the latch portion 112 latching the disc 108 in position and terminating the linear movement of the housing 54 and the target 20 along the track 22. It should be clear upon each engagement of a projectile 18 with the depending portion 114, the disc 108 is allowed to rotate another revolution thus moving the scoring target 20 an additional predetermined distance along the track 22.

As previously mentioned, the object of the competitive action game 10 is to move the target 20 the full length of the track 22 from the end 24 to the scoring end 26. To designate which player's target 20 reaches the scoring end 26 first, a scoring device or flag generally designated by the reference numeral 116 (FIGS. 2 and 6) is engaged and is pivoted upwardly to indicate completion of the movement of the target 20 along the track 22. The scoring device 116, in the preferred embodiment, is a flag 118 mounted to the playing surface 16 by a pivot pin 120 secured to a bracket 122 on the playing surface 16. The scoring flag 118, in a nonscoring position, lies flat along the playing surface 16 as shown by the solid lines. The flag 118 includes an upstanding leg 124 including a pin 126 extending at right angles with the track 22. The target housing 54 includes an upward extension 128 of the flange 70 (FIG. 5). The extension 128 includes a small flange 130 and a leading edge flange 132 having one inclined surface. As the target housing 54 travels toward the upstanding leg 124 of the scoring flag 118, the pin 126 engages the edge surface of the extension 128 causing the flag 118 to pivot upwardly. As the flag reaches its top position the flag support arm slides along the inclined surface of the flange 132 and is captured between the sides of flange 130 and flange 132 causing the flag 118 to become locked in vertical position. This indicates the completion of the travel of the target 20 along the track 22 and determines the winner of the game.

While only a single embodiment of the present invention has been shown, it will be understood that various changes and modifications may occur to those skilled in the art and it is contemplated by the appended claims to cover all such changes and modifications as fall within the true spirit and scope of the present invention.

What is claimed as new and desired to be secured by Letters Patent of the United States is:

1. A target game apparatus comprising:

a playing surface including at least one player station defined thereon;

at least one projectile;

at least one target device;

means defined at said player station for launching a projectile and means for returning said projectile to said launching means;

support means for mounting said target device for movement transversely with respect to the player station; and target drive means including a rack on the playing surface and a gear rotatably mounted on the support means and engaging said rack for movement of the target a predetermined distance along said playing surface upon actuation thereof by control of a projectile.

2. The game apparatus of claim 1 further comprising a scoring device pivotally mounted on said track and engaged by said housing to indicate a score.

3. The game apparatus of claim 1 wherein said target device includes means for biasing the same toward one end of said rack.

4. The game apparatus of claim 1 wherein said target device includes latch means for preventing said support means from moving, said latch means including a disc rotatably mounted on said support means and secured to a gear so as to rotate with said gear as said support means moves, and a latch resiliently engaging said disc to prevent rotation of said disc, said latch including a portion engageable by a projectile from said launching means to release said disc and allow rotation thereof and movement of said support means for one rotation of said disc.

5. The game apparatus of claim 4 wherein said playing surface is inclined downwardly from said target device toward said launching means.

6. A target game apparatus, comprising:

a playing field including a player station on said field;

a plurality of projectiles;

a plurality of projectile launching means at said player station for launching said projectiles;

projectile return means for returning said projectiles to said launching means;

target means mounted on the field including a track with first and second ends, a housing and gear rotatably mounted thereon with said gear meshingly engaging said track;

latch means for releasably latching said target means and said gear to prevent rotation thereof; and release means associated with said latch means and including biasing means to cause movement of said target means a preselected distance along said track upon engagement thereof by one of said projectiles.

7. The game apparatus of claim 6 further comprising:

score indicating means for indicating the complete travel of said target means from the first end of said track to the second end, said score indicating means including a flag pivotally mounted adjacent said second end for pivoting to an upright position upon engagement by said target means.

8. The target game apparatus of claim 6 wherein said playing field is inclined downward from said target means to said player station.

9. The target game apparatus of claim 6 further comprising a second player station and second launching means on an opposite side of said playing field from said first player station.

10. The target game apparatus of claim 6 further comprising second target means movably mounted on said playing field, said second target means including a second track with first and second ends and a second housing including a second gear meshingly engaging said second track;

second latching means for releasably latching said second target means and said second gear to prevent rotation of said second gear on said second track under the influence of said biasing means; and second release means for allowing the movement of said second target means a preselected distance along said second track upon engagement of said projectile means with said second target means.

11. A competitive action game comprising:

a playing field including a pair of player positions, each player position including launching means for launching projectiles;

a plurality of projectiles to be propelled by said launching means;

a pair of racks on said playing field;

means defining a target mounted on each of said racks; and means for moving said target means a preselected distance along said rack upon engagement of one of said projectiles with one of said targets.

12. The competitive game of claim 11 wherein said target means includes latch means for locking said target means on said racks and releasing said target means for movement along said racks upon being engaged by one of said projectiles.

13. The game set forth in claim 12 wherein said moving means further comprises biasing means for biasing said target means in a selected direction along said racks to move said target means upon engagement by one of said projectiles.

14. The game set forth in claim 11 further comprising a score indicating flag pivotally mounted on said track and engageable by said target means to pivot said flag to indicate a score.

15. The game set forth in claim 11 wherein each of said target means includes a housing mounted on one of said racks and a toothed gear rotatably mounted on said housing engaging said rack.

16. The game set forth in claim 15 wherein said latch means includes a disc rotatably secured to said housing and to said gear to rotate therewith, and a resilient latch mounted on said housing and engaging said disc and said gear, said latch including a depending portion engageable by a projectile to release said disc and allow rotation thereof and movement of said target means along said rack.

* * * * *